United States Patent [19]

Jadwin et al.

[11] 3,944,493

[45] Mar. 16, 1976

[54] ELECTROGRAPHIC TONER AND DEVELOPER COMPOSITION

[75] Inventors: Thomas A. Jadwin, Rochester; Robert C. Storey, Penfield, both of N.Y.

[73] Assignee: Eastman Kodak Company, Rochester, N.Y.

[22] Filed: May 16, 1974

[21] Appl. No.: 470,425

[52] U.S. Cl. ..... 252/62.1 P; 252/62.1 R

[51] Int. Cl.[2] ..... G03G 9/00

[58] Field of Search ..... 252/62.1, 62 P; 96/15 D

[56] References Cited

UNITED STATES PATENTS

| | | | |
|---|---|---|---|
| 3,417,019 | 12/1968 | Beyer | 252/62.1 |
| 3,565,654 | 2/1971 | Story | 252/62.1 |
| 3,669,922 | 6/1972 | Bartsch et al. | 252/62.1 |

OTHER PUBLICATIONS

Research Disclosure, Oct., 1972, pp. 57–58.

*Primary Examiner*—Mary F. Kelley
*Attorney, Agent, or Firm*—R. P. Hilst

[57] ABSTRACT

The present invention relates to the use of low levels of certain alkoxylated amines as charge control agents for an electrostatic toner contained in dry electrographic developer compositions.

9 Claims, 3 Drawing Figures

TEMPERATURE 28° C.

TONER A
TONER B
USEFUL CHARGE RANGE
NET TONER CHARGE (μcoul/gm.)
0
10
20
30
40
50
60
20
40
60
70
80
100
RELATIVE HUMIDITY (%)

USEFUL CHARGE RANGE
1
2
3
4
NET TONER CHARGE (μcoul/gm.)
0
10
20
30
40
30,000
NUMBER OF SIMULATED PRINTS 40
30
20
10
0
NET TONER CHARGE (μ coul/gm.)
USEFUL CHARGE RANGE
2
3
4
5
1
30,000
NUMBER OF SIMULATED PRINTS

ELECTROGRAPHIC TONER AND DEVELOPER COMPOSITION

BACKGROUND OF THE INVENTION

This invention relates to electrography and to a particulate toner composition and a dry electrographic developer composition containing such a toner useful in the development of latent electrostatic charge images.

Electrographic imaging and developing processes, e.g. electrophotographic imaging processes and techniques, have been extensively described in both the patent and other literature, for example, U.S. Pat. Nos. 2,221,776 issued Nov. 19, 1940; 2,277,013 issued Mar. 17, 1942; 2,297,691 issued Oct. 6, 1942; 2,357,809 issued Sept. 12, 1944; 2,551,582 issued May 8, 1951; 2,825,814 issued Mar. 4, 1958; 2,833,648 issued May 6, 1958; 3,220,324 issued Nov. 30, 1965; 3,220,831 issued Nov. 30, 1965; 3,220,833 issued Nov. 30, 1965; and many others. Generally these processes have in common the steps of forming a latent electrostatic charge image on an insulating electrographic element. The electrostatic latent image is then rendered visible by a development step in which the charged surface of the electrographic element is brought into contact with a suitable developer mix. Conventional dry developer mixes include toner or marking particles and may also include a carrier vehicle that can be either a magnetic material such as iron filings, powdered iron or iron oxide, or a triboelectrically chargeable, non-magnetic substance like glass beads or crystals of inorganic salts such as sodium or potassium fluoride. The toner or marking particles typically contain a resinous material suitably colored or darkened, for contrast purposes, with a colorant like dyestuffs or pigments such as carbon black.

One method for applying a suitable dry developer mix to a charged image-bearing electrographic element is by the well-known magnetic brush process. Such a process generally utilizes an apparatus of the type described, for example, in U.S. Pat. No. 3,003,462 issued Oct. 10, 1961 and customarily comprises a non-magnetic rotatably mounted cylinder having fixed magnetic means mounted inside. The cylinder is arranged to rotate so that part of the surface is immersed in or otherwise contacted with a supply of developer mix. The granular mass comprising the developer mix is magnetically attracted to the surface of the cylinder. As the developer mix comes within the influence of the field generated by the magnetic means within the cylinder, particles thereof arrange themselves in bristle-like formations resembling a brush. The brush formations that are formed by the developer mix tend to conform to the lines of magnetic flux, standing erect in the vicinity of the poles and laying substantially flat when said mix is outside the environment of the magnetic poles. Within one revolution the continually rotating cylinder picks up developer mix from a supply source and returns part or all of this material to this supply. This mode of operation assures that fresh mix is always available to the surface of the charged electrographic element at its point of contact with the brush. In a typical rotational cycle, the roller performs the successive steps of developer mix pickup, brush formation, brush contact with the electrographic element, e.g. a photoconductive element, brush collapse and finally mix release.

In magnetic brush development, as well as in various other types of electrographic development wherein a dry triboelectric mixture of a particulate carrier vehicle and a toner powder are utilized, e.g., cascade development such as described in U.S. Pat. Nos. 2,638,416 and 2,618,552, it is advantageous to modify the triboelectric properties of the toner powder so that a uniform, stable relatively high net electrical charge may be imparted to the toner powder by the particulate carrier vehicle. It is also highly advantageous if the triboelectric properties of the toner powder remain fairly uniform even when the toner powder is used under widely varying relative humidity (RH) conditions.

A variety of methods and material for modifying the triboelectric properties of particulate toner particles have been proposed. For example, Olson, U.S. Pat. No. 3,647,696 issued Mar. 7, 1972 describes a uniform polarity resin electrostatic toner containing a mono- or di-functional organic acid nigrosine salt. The nigrosine salt described in U.S. Pat. No. 3,647,696 aids in providing a relatively high uniform net electrical charge to a toner powder containing such a nigrosine salt. However, subsequent testing and development relating to the use of such organic acid nigrosine salts has shown that such materials, when incorporated in a toner composition, contribute to a decrease in the adhesion of the toner particles to a suitable paper receiving sheet. For example, it has been found that when a toner image is transferred from a charge image-bearing electrographic element to a paper receiving sheet and fixed to the receiving sheet, the image formed on the receiving sheets tends to flake off when the sheet is bent or folded.

Other materials which have been employed as modifying agents for dry toner compositions include various long-chain anionic or cationic materials such as various surfactants. Typical of these surfactant materials are the long chain quaternary ammonium surfactants. The use of such materials is described, for example, in British Pat. No. 1,174,573 published Dec. 17, 1969, at page 2, column 2 through page 3. In addition, Jacknow et al, U.S. Pat. No. 3,577,345 issued May 4, 1971, describes a solid metal salt of a fatty acid admixed with one of various other described solid additives as a useful modifying combination for a dry toner composition.

Still other materials which have been found useful as charge control agents for electrostatic toner compositions are various non-surfactant short chain quaternary ammonium salts such as those described in Jadwin et al. U.S. Pat. Application Ser. No. 399,266; filed Sept. 20, 1973. These non-surfactant short chain quaternary salts have been found capable of providing relatively high, uniform net electrical charge to a toner powder in which these materials are incorporated without any substantial deleterious effect on the adhesion properties of the toner composition. Although the above-described non-surfactant short chain quaternary ammonium salts have been found quite useful, it would be desirable to have a charge control agent for a dry electrostatic developer composition which imparts even greater RH stability to the developer composition.

In addition to the above-mentioned materials which have been used specifically to modify the triboelectric properties of electrostatic toner particles contained in dry electrographic developer compositions, still other literature sources have suggested amines as a general class of materials which may be incorporated as an additive for various purposes in a wide variety of printing and marking compositions, including printing inks and liquid electrographic developers as well as dry electrographic developers. For example, with respect to dry electrographic developer compositions, U.S. Pat. No. 3,565,805 issued Feb. 23, 1971 describes the use of chemically inert organic oleaginous liquids such as alkylamines containing 2 to 18 carbon atoms as "tackifying" agents for electrostatic toner particles; and British Patent 1,117,224 describes the use of aliphatic amines and polypropanol and polyethanol amine surfactants as one of a wide variety of different kinds of surfactants which may be employed in the emulsion polymerization of resins useful in the manufacture of electrostatic toner particles. In addition, German OLS 2,241,515 dated May 3, 1973 and OLS 2,128,499 dated Dec. 16, 1971 describe a porous magnetic electrostatic toner composition having adsorbed to the surface, in an amount greater than about 4.7 weight percent, a non-volatile amine. This toner composition is used in the development of an electrostatic latent image to form a toner image which is contacted to a light sensitive layer of a two-component diazo sheet. The adsorbed amine of the toner image allegedly renders the light sensitive layer of the diazo material alkaline at the various points where it contacts the layer so that development of the diazo material can proceed.

With respect to various conductive printing ink compositions, it may be noted that U.S. Pat. Nos. 3,427,258 issued Feb. 11, 1969 and British Pat. No. 1,169,703 dated Nov. 24, 1966 describe depositing various amines, including alkylene diamines and amine surfactants, in amounts greater than about 2 weight percent, on the surface of ink particles to increase the electrical conductivity thereof to a level generally less than about $10^{10}$ ohm-cm.

With respect to liquid electrographic developer compositions, U.S. Pat. No. 3,417,019 issued Dec. 7, 1968 describes the incorporation of at least 3 up to about 50 percent by weight of a variety of materials including heavy metal soaps, and non-ionic, anionic, and cationic surfactants as charge agents for the solid toner particles contained in liquid electrographic developers. Among the many charge agents materials disclosed for use in liquid developers in U.S. Pat. No. 3,417,019 are polyethylene glycols containing amino groups. Unfortunately, because of the many physical and electrical differences existing between liquid and dry electrographic developers, many, if not most, of the charge agents described therein are unsatisfactory for use in dry developers.

SUMMARY OF THE INVENTION

In accordance with the present invention there is provided an improved dry particulate electrostatic toner composition and a dry developer composition containing said toner triboelectrically attractable to a particulate carrier vehicle. The improved toner composition of the invention comprises a resin binder and dispersed in said binder a small amount, i.e. less than two percent by weight, of certain alkoxylated amine charge control agents. Advantageously, a suitable colorant such as a pigment or dye may also be incorporated in the toner. Typical of the amine charge control agents useful in the present invention are materials having the following formula:

$$R-N\begin{matrix}-[(CH_2)_aO]_xH \\ -[(CH_2)_bO]_yH\end{matrix}$$

wherein: $a$ and $b$ represent integers of from 2 to about 4 and may be the same or different, $x$ and $y$ represent integers of from 1 to about 10 and may be the same or different, and R is an alkyl group containing from about 8 to about 30 carbon atoms.

DESCRIPTION OF THE PREFERRED EMBODIMENTS

Figure 1:
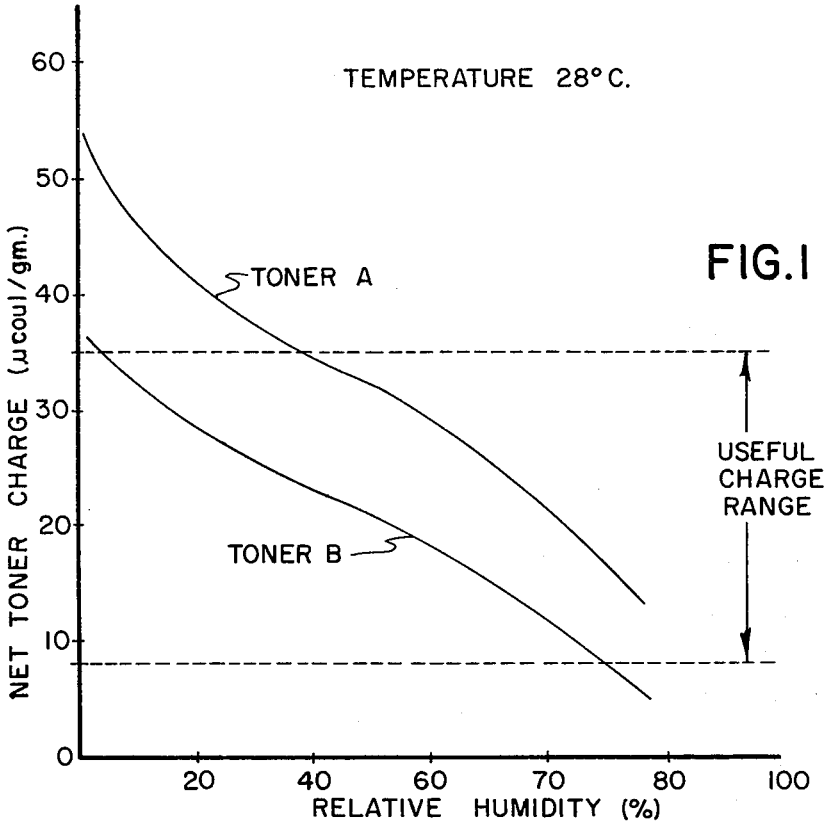
FIG. 1 is a graph illustrating the effect of increasing relative humidity (at 28°C) on the net toner charge of two similar electrostatic toner compositions, A and B, except that Toner A has incorporated therein a prior art charge control agent of tetrapentylammonium chloride and Toner B has incorporated therein an alkoxylated charge control agent of the present invention.

The present invention has been found to provide numerous advantages. Among others, the alkoxylated amine charge control agents used in the invention have been found to provide a particulate toner composition which exhibits a relatively high, uniform and stable net toner charge when admixed with a suitable particulate carrier vehicle. Moreover, the amount of deleterious toner throw-off is generally quite low. In addition, the alkoxylated amine charge control agents used in the invention have been found to have no deleterious effect on the adhesion properties of the resultant toner composition containing these charge control agents when such toner compositions are fused to conventional plain paper receiving sheets.

In addition to the foregoing advantages, the charge control agents used in the present invention have been found surprisingly effective at providing a resultant electrostatic toner composition which is capable of maintaining a relatively high, stable net toner charge level when admixed with a particulate carrier vehicle even under widely varying relative humidity (RH) conditions. This is particularly advantageous as it permits one to obtain effective electrographic development with low amounts of toner throw-off even at relatively low and high RH conditions, for example, 5% RH at 28°C and 90% RH at 28°C.

Moreover, the particular molecular structure of charge agents of the present invention, namely the combination of the long chain alkyl group and the two alkoxyl-containing groups surrounding the central nitrogen atom, provide an amine structure which is biologically and environmentally safe as compared to amines in general such as many alkylene amines which possess undesirably high toxicity levels.

It has further been found that particulate resinous toner particles containing an effective amount of the above-described alkoxylated amine charge control agents generally result in good to excellent electrographic developed images exhibiting good uniform density with little or no background scumming.

The resins useful as binders in the practice of the present invention include those resins conventionally employed in electrostatic toners. Useful resins generally have a glass transition temperature within the range of from 40° to 120°C. Preferably, toner particles prepared from these resinous materials have relatively high caking temperature, for example, higher than about 55°C., so that the toner powders may be stored for relatively long periods of time at fairly high temperatures without having individual particles agglomerate and clump together. The softening temperature of useful resins preferably is within the range of from about 40°C. to about 200°C. so that the toner particles can readily be fused to conventional paper receiving sheet to form a permanent image. Especially preferred resins are those having a softening temperature within the range of from about 40°C. to about 65°C. because toners containing these binders can be used in high speed electrographic copy machines employing plain paper as the receiving sheet to which the toned images are fused. Of course, where other types of receiving elements are used, for example, metal plates such as certain printing plates, resins having a softening temperature and glass transition temperature higher than the values specified above may be used.

As used herein the term "softening temperature" refers to the softening temperature of a resin as measured by E. I. duPont de Nemours Company, Model 941 TMA (Thermal Mechanical Analyzer). Glass transition temperature (Tg) as used herein refers to the temperature at which a polymeric material changes from a glassy polymer to a rubbery polymer. This temperature (Tg) can be measured by differential thermal analysis as disclosed in *Techniques and Methods of Polymer Evaluation*, Vol. 1, Marcel Dekker, Inc., N.Y. 1966.

Among the various resins which may be employed in the toner particles of the present invention are polystyrene containing resins, polycarbonates, rosin modified maleic alkyd resins, polyamides, phenol-formaldehyde resins and various derivatives thereof, polyester condensates, modified alkyd resins and the like, aromatic resins containing alternating methylene and aromatic units such as described in Merrill et al, U.S. Ser. No. 168,389, filed Aug. 2, 1971, and fusible cross-linked polymers as described in Jadwin et al, U.S. Ser. No. 380,317, filed July 18, 1973, and the like.

Especially useful toner resins include certain polycarbonates such as those described in U.S. Pat. No. 3,694,359 issued Sept. 26, 1972, and which includes polycarbonate materials containing an alkylidene diarylene moiety in a recurring unit and having from 1 to about 10 carbon atoms in the alkyl moiety. Other useful resins having the above-described physical properties include polymeric esters of acrylic and methacrylic acid such as poly(alkylacrylate) including poly(alkylmethacrylate) wherein the alkyl moiety can contain from 1 to about 10 carbon atoms. Additionally, other polyesters having the aforementioned physical properties are also useful.

Still other especially useful resins are various styrene-containing resins. Such polymers typically comprise a polymerized blend of from about 40 to about 100 percent by weight of styrene, including styrene homologs; from about 0 to about 45 percent by weight of one or more lower alkyl acrylates or methacrylates having from 1 to about 4 carbon atoms in the alkyl moiety such as methyl, ethyl, isopropyl, butyl, etc.; and from about 0 to about 50 percent by weight of one or more vinyl monomers other than styrene, for example, a higher alkyl acrylate or methacrylate (including branched alkyl and cycloalkyl acrylates and methacrylates) having from about 6 to 20 or more carbon atoms in the alkyl group. A typical styrene-containing resin prepared from a copolymerized blend as described hereinabove are copolymers prepared from a monomeric blend of 40 to 60 percent by weight styrene or styrene homolog, from about 20 to about 50 percent by weight of a lower alkyl acrylate or methacrylate and from about 5 to about 30 percent by weight of a higher alkyl acrylate or methacrylate such as ethylhexyl acrylate. Especially useful styrene-containing binder resins are cross-linked fusible styrene-containing polymers such as described in the above-referenced Jadwin et al patent application incorporated herein by reference thereto. A variety of other useful styrene containing toner materials are disclosed in the following U.S. Pat. Nos.: 2,917,460 issued Dec. 15, 1959; Re. 25,136 issued Mar. 13, 1962; 2,788,288 issued Apr. 9, 1957; 2,638,416 issued Apr. 12, 1953; 2,618,552 issued Nov. 18, 1952 and 2,659,670 issued Nov. 17, 1953.

The amount of binder resin employed in the toner particles used in the present invention may vary depending on the amounts of other addenda which one may desire to incorporate in the toner composition. For example, various colorant and/or magnetic materials can advantageously be incorporated in the toner particles when the particles are desired for use in certain applications requiring such addenda. Typically, however, the binder resin is present in an amount equal to or greater than about 50 percent by weight of the toner composition. And, in accord with certain particularly useful embodiments of the invention where it is desired to employ the resultant toner composition in a high speed electrographic office copy machine, it is desirable to use an amount of binder resin within the range of from about 75 to about 98 weight percent based on the total weight of the particulate toner composition.

The toner particles of the present invention can be prepared by various methods. One convenient technique for preparing these toners is spray-drying. Spray-drying involves dissolving the polymer and adding the toner colorant and charge control agent to a volatile organic solvent such as dichloromethane. This solution is then sprayed through an atomizing nozzle using a substantially nonreactive gas such as nitrogen as the atomizing agent. During atomization, the volatile solvent evaporates from the airborne droplets, producing toner particles of the uniformly dyed or pigmented resin. The ultimate particle size is determined by varying the size of the atomizing nozzle and the pressure of the gaseous atomizing agent. Particles of a diameter between about 0.1 micron and about 100 microns may be used; although, in general, present day office copy devices typically employ particles between about 1.0 and 30 microns. However, larger particles or smaller particles can be used where desired for particular methods of development or particular development conditions. For example, in powder cloud development such as described in U.S. Pat. No. 2,691,345 issued Oct. 12, 1954, extremely small toner particles on the order of about 0.01 microns may be used.

Another convenient method for preparing the toner composition of the present invention is melt-blending. This technique involves melting a powdered form of polymer or resin and mixing it with suitable colorants, such as dyes or pigments, and the charge control agent. The resin can readily be melted on heated compounding rolls which are also useful to stir or otherwise blend the resin and addenda so as to promote the complete intermixing of these various ingredients. After thorough blending, the mixture is cooled and solidified. The resultant solid mass is then broken into small particles and finely ground to form a free-flowing powder of toner particles. These particles typically have an average particle size or average diameter within the range of from about 0.1 to about 100 microns.

As described hereinabove the alkoxylated amine charge control agents used in the invention are added to the resinous toner composition in an amount effective to improve the charge properties of the toner composition. The addition of a charge control agent improves the charge uniformity of a particular toner composition, i.e. acts to provide a toner composition in which all or substantially all of the individual discrete toner particles exhibit a triboelectric charge of the same sign (negative or positive) with respect to a given carrier vehicle, increases the net electrical charge exhibited by a specified quantity of toner particles relative to a given carrier vehicle, and reduces the amount of "toner throw-off" of a given toner composition. As used herein, the phrases "net electrical charge exhibited by a toner powder" or "net toner charge" are equivalent and are defined as the total electrical charge exhibited by a specified amount of a particular toner when admixed with a specified amount of a particular carrier vehicle. Although the phenomenon by which such an electrical charge is imparted is not fully understood, it is believed due in large part to the triboelectric effect caused by the physical admixture of toner and carrier. As used herein, the term "toner throw-off" is defined as the amount of toner powder thrown out of a developer mix as it is mechanically agitated, e.g., in a development apparatus. Aside from the extraneous contamination problems inherent with airborne toner dust in the development apparatus, "toner throw-off" also leads to imaging problems such as unwanted background and scumming of the electrographic image-bearing element.

The amount of the alkoxylated amine charge control agent useful in the present invention is important. Generally, it has been found desirable to employ an amount of amine charge control agent within the range of from about 0.1 to less than 2 weight percent and preferably 0.3 to about 1.5 weight percent based on the total weight of the particulate toner composition. It has been found that if amounts much lower than those specified above are used, the charge control agent tends to exhibit little or substantially no improvement in the properties of the toner composition. As amounts more than about 1.5 weight percent of the charge control agent are used, especially amounts more than about 2.0 weight percent, it has been found that the net toner charge exhibited by the resultant toner composition becomes quite unstable and is substantially reduced. Of course, it must be recognized that the optimum amount of charge control agent to be added will depend in part on the particular alkoxylated amine charge control agent selected and the particular toner composition to which it is added. However, the amounts specified hereinabove are typical of the useful range of charge control agent used in conventional dry toner materials. Advantageously, the charge agents used in the present invention are uniformly distributed throughout the resin binder of the toner particles.

As indicated, the amine charge control agents employed in the present invention typically have the formula:

$$R-N\begin{matrix}\diagup [(CH_2)_aO]_xH \\ \diagdown [(CH_2)_bO]_6H\end{matrix}$$

wherein: $a$ and $b$ represent integers of from 2 to about 4 and may be the same or different; $x$ and $y$ represent integers of from 1 to about 10 and may be the same or different; and R is an alkyl group containing from about 8 to about 30 carbon atoms, including straight chain-, branched chain-, and cyclo-alkyl groups. Best results have generally been obtained in accord with the invention using ethoxylated amine charge control agents having the above formula wherein $a$ and $b$ are 2; $x$ and $y$ represent integers of 1 to about 10, the sum of $x$ and $y$ equal to or less than about 10; and R is a straight-chain alkyl group containing 12 to about 22 carbon atoms. The alkoxylated amines most useful in the present invention at normal pressure (i.e. 1 atm.) and temperature (28° C) conditions are wax-like solid materials. Lower molecular weight liquid alkoxylated amines are generally not as useful as a charge agent as the wax-like solid materials because these liquid amines impair the keeping properties of the toner.

A variety of colorant materials selected from dyestuffs or pigments may be employed in the toner materials of the present invention. Such materials serve to color the toner and/or render it more visible. Of course, suitable toner materials having the appropriate charging characteristics can be prepared without the use of a colorant material where it is desired to have a developed image of low optical opacity. In those instances where it is desired to utilize a colorant, the colorants used, can, in principle, be selected from virtually any of the compounds mentioned in the *Colour Index* Volumes 1 and 2, Second Edition.

Included among the vast number of useful colorants would be such materials as Hansa Yellow G (C.I. 11680), Nigrosine Spirit soluble (C.I. 50415), Chromogen Black ET00 (C.I. 45170), Solvent Black 3 (C.I. 26150), Fuchsine N (C.I. 42510), C.I. Basic Blue 9 (C.I. 52015), etc. Carbon black also provides a useful colorant. The amount of colorant added may vary over a wide range, for example, from about 1 to about 20 percent of the weight of the thermoplastic resin. Particularly good results are obtained when the amount is from about 2 to about 10 percent. In certain instances, it may be desirable to omit the colorant, in which case the lower limit of concentration would be zero.

The toners of this invention can be mixed with a carrier vehicle to form developing compositions. The carrier vehicles which can be used with the present toners to form new developer compositions can be selected from a variety of materials. Suitable carrier vehicles useful in the invention include various non-magnetic particles such as glass beads, crystals of inorganic salts such as sodium or potassium chloride, hard resin particles, metal particles, etc.

In addition, magnetic carrier particles can be used in accordance with the invention. In fact, the toner compositions of the present invention are especially suited for use with magnetic carrier particles as the problem of "toner throw-off" is especially bothersome in magnetic brush development processes. Suitable magnetic carrier particles are particles of ferromagnetic materials such as iron, cobalt, nickel, and alloys and mixtures thereof. Other useful magnetic carriers are mixtures of rough-surfaced, irregularly shaped magnetic particles and smooth-surfaced, regularly-shaped magnetic particles such as described in Trachtenberg et al, U.S. Ser. No. 236,724 filed Mar. 21, 1972. Other useful magnetic carriers are particles wherein each individual carrier particle contains a plurality of magnetic particles uniformly dispersed throughout an electrically insulating polymeric matrix such as described in Canadian Pat. No. 835,317 dated Feb. 24, 1970. Other useful magnetic carriers are ferromagnetic particles overcoated with a thin layer of various film-forming resins, for example, the alkali-soluble carboxylated polymers described in Miller, U.S. Pat. No. 3,547,822 issued Dec. 15, 1970. Still other useful resin coated magnetic carrier particles are described in Miller, U.S. Pat. No. 3,632,512 issued Jan. 4, 1972; McCabe, U.S. Ser. No. 236,765, filed Mar. 21, 1972, entitled "Electrographic Carrier Vehicle and Developer Composition — Case B"; and Kasper U.S. Ser. No. 236,614, filed Mar. 21, 1972, entitled, "Electrographic Carrier Vehicle and Developer Composition — Case D". Other useful resin coated magnetic carrier particles include carrier particles coated with various fluorocarbons such as polytetrafluoroethylene, polyvinylidene fluoride, and mixtures thereof including copolymers of vinylidene fluoride and tetrafluoroethylene.

A typical developer composition containing the above-described toner and a carrier vehicle generally comprises from about 1 to about 10 percent by weight of particulate toner particles. Typically, the carrier particles are larger than the toner particles. Conventional carrier particles have a particle size on the order of from about 30 to about 1200 microns, preferably 60–300 microns.

The toner and developer compositions of this invention can be used in a variety of ways to develop electrostatic charge patterns or latent images. Such developable charge patterns can be prepared by a number of means and be carried for example, on a light sensitive photoconductive element or a non-light sensitive dielectric-surfaced element such as a receiver sheet. One suitable development technique involves cascading the developer composition across the electrostatic charge pattern; while another technique involves applying toner particles from a magnetic brush. This latter technique involves the use of a magnetically attractable carrier vehicle in forming the developer composition. After imagewise deposition of the toner particles, the image can be fixed by heating the toner to cause it to fuse to the substrate carrying the toner. If desired, the unfused image can be transferred to another support such as a blank sheet of copy paper and then fused to form a permanent image.

The following examples are included for a further understanding of the invention.

EXAMPLE 1

In this example the alkoxylated amine charge control agents of the present invention were compared to tetrapentylammonium chloride, a highly useful charge control agent described in U.S. Ser. No. 399,266 referred to previously herein.

Two dry toner compositions were prepared as described below.

Toner A 100 parts by weight - Poly(styrene-co-methyl methacrylate-co-ethylhexyl methacrylate-co-divinyl benzene)

1 part by weight - Tetrapentylammonium chloride 4 parts by weight of conductive carbon black particles Toner B 100 parts by weight - Poly(styrene-co-methyl methacrylate-co-ethylhexyl methacrylate-co-divinyl benzene)

0.5 part by weight - Ethomeen 18/12 (an ethylene oxide condensation product of a primary fatty amine purchased from ARMAK Chemical Corporation)

5 parts by weight of conductive carbon black particles

Toners A and B were admixed with magnetic carrier particles having an average particle size of about 125 microns comprising Hoeganaes EH sponge iron coated with a fluorocarbon resin to form two different developers, Developer A and B respectively. Each developer was composed of 3% by weight toner and 97% by weight carrier particles. The effective net toner charge ($\mu$coul/gram) imparted to the toner particles of these two developers was measured at various RH levels, and the results of these measurements are depicted in FIG. 1. Specifically, after thoroughly mixing together the toner and carrier particles of each developer, the net toner charge is measured using an iron Faraday tube and a Keithley electrometer in the following manner: a weighed portion of each of the developers is placed in the iron tube that is covered at one end with a 200 mesh screen that retains all carrier particles within the tube. The iron tube is connected in series with a capacitor to ground. An air stream is then directed through the tube, blowing toner particles off the carrier, through the 200 mesh screen at the exit end. The potential resulting on the capacitor is measured by the electrometer. The potential obtained is converted to electrical charge in microcoulombs and this figure is divided by the weight in grams of the toner that is removed from the tube, providing the net toner charge in microcoulombs per gram. It will be noted that in a triboelectric charge range of 8–35 $\mu$coul/gram, that Toner B is operable at a much wider range of relative humidities than is Toner A. The triboelectric charge range of 8–35 $\mu$coul/gram has been found to be a useful charge range for many magnetic brush development systems.

EXAMPLE 2

Part 1

A control toner (Toner C) was prepared by melt blending the addenda below on a 2-roll mill, cooling the material, and then grinding on a fluid energy mill to an average particle size of between 3 to 15 microns.

100 parts by weight of poly(styrene-co-methyl methacrylate-co-ethylhexyl methacrylate-co-divinyl benzene)

5 parts by weight of finely-divided conductive carbon black

The above toner was mixed for 15 minutes at a 3.5 percent level with the carrier of Example 1 to form a developer. This developer was then put through a simulation test representing a 30,000 print run on an electrophotographic document copier using magnetic brush development. The data indicated that the net toner charge, as measured in Example 1 using an iron Faraday tube and a Keithley electrometer, started at a low positive level and decreased with use (See curve 4 of FIG. 2 and Table A). A developer exhibiting these charge properties would not perform in a stable manner in a magnetic brush application.

Part 2

A toner was prepared as in Part 1 except that 0.5 parts by weight of ethoxylated amine having the formula:

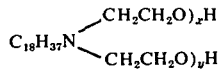

wherein $x+y=2$ was added during the melt blending operation. A developer was prepared as in part 1 and its charge behavior followed during a simulated 30,000 print run as in Part 1. The data indicated that the developer had a high positive charge level and excellent charge stability over its measured lifetime (See curve 1 of FIG. 2 and Table A). An actual print test of > 100,000 electrophotographic prints using a test electrophotographic document copier with magnetic brush development indicated that this material had excellent imaging characteristics and charge stability over the test duration.

Part 3

A toner was prepared as in Part 1 except that 0.5 parts of an ethoxylated amine having the same formula as the ethoxylated amine of Part 2 except that in this case $X + Y = 10$ was added during the melt blending operation. A developer was prepared and evaluated as in Part 1. The developer in this case had an intermediate but very acceptable positive charge level and exhibited excellent charge stability with life (See curve 2 of FIG. 2 and Table A).

Part 4

A toner was prepared as in Part 1 except that 0.5 parts of an ethoxylated amine having the same formula as the ethoxylated amine of Part 2 except that in this case $X + Y = 50$ was added during the melt blending operation. A developer was prepared and evaluated in the manner noted in Part 1. Its charge behavior (See curve 3 of FIG. 2 and Table A) indicated that the relatively high levels of ethylene oxide decreased the charging properties of the material so as to render it ineffective as a charge agent. An actual print test on this material using a test electrophotographic document copier with magnetic brush development showed low charge levels and severe contamination of the interior of the copier from developer dusting, i.e., toner throw-off.

Table A

Figure 2:
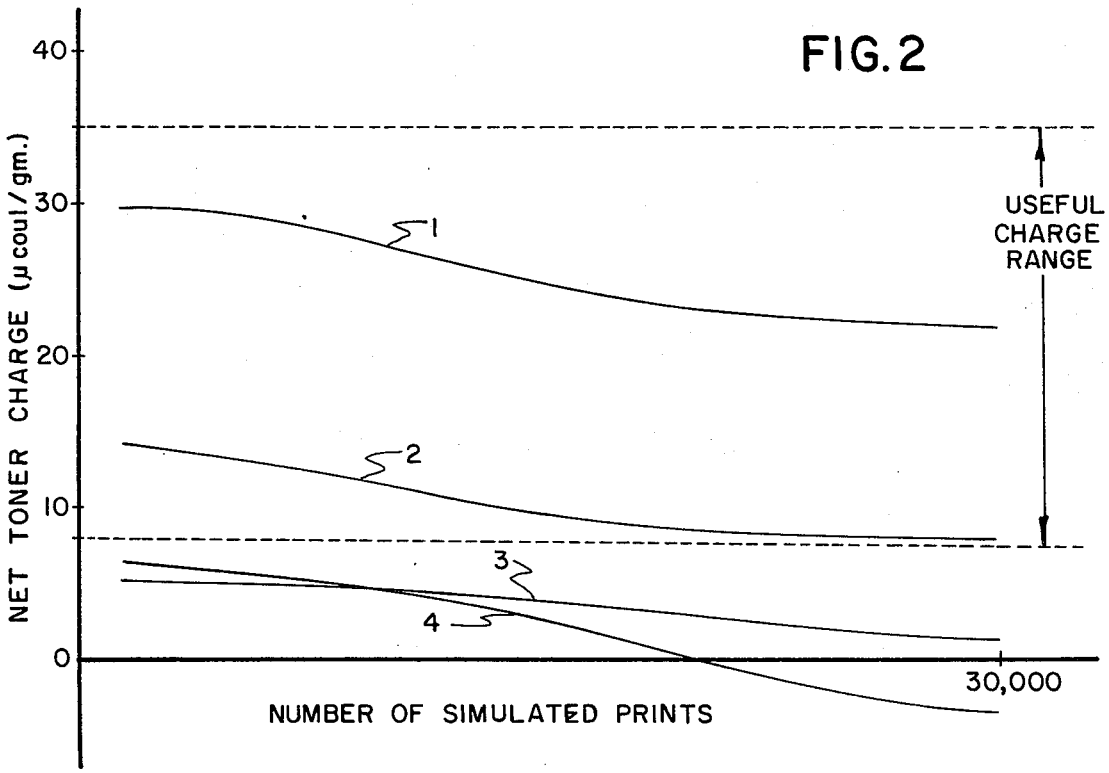
FIG. 2 is a graph illustrating the effect on the net toner charge of four toner compositions, Curves 1–4, subjected to an identical simulation test representing a 30,000 print run on an electrophotographic document copier. The difference among the four toner compositions tested is the type of incorporated alkoxylated charge control agent.

Simulated 30,000 Print Test of FIG. 2

| Example 2 | X + Y | Commerical Name | Net Toner Charge(μcoul/gm) 15 min.[1] | 1 hour[2] | 2 hours[3] | 5 hours[4] |
|---|---|---|---|---|---|---|
| Part 2 | 2 | Ethomeen 18/12* | 29 | 29 | 26 | 22 |
| Part 3 | 10 | Ethomeen 18/20* | 14 | 12 | 10.3 | 7.7 |
| Part 4 | 50 | Ethomeen 18/60* | 5.0 | 4.1 | 4.2 | 1.5 |
| Part 1 | Control - No charge agent | | 5.9 | 4.1 | 3.1 | −3.5 |

*purchased from ARMAK Chemical Corporation

[1] 15 minutes after start of simulated print test equivalent to approx. 1500 prints

[2] 1 hour after start of simulated print test equivalent to approx. 6,000 prints

[3] 2 hours after start of simulated print test equivalent to approx. 12,000 prints

[4] 5 hours after start of simulated print test equivalent to approx. 30,000 prints

EXAMPLE 3

A number of dry toner formulations were prepared as in Example 2 in order to illustrate the effective concentration range of ethoxylated amines. A concentration series, using the ethoxylated amine described in Example 2, Part 2 at levels varying from 0.00 to 4.5 percent by weight is shown by curves 1–5, respectively of FIG. 3. The data indicated that in a simulated print test of about 30,000 prints, levels of < 2 percent and preferably about 0.3 to about 1.5 percent maintained a charge level within the useful range of about 8 – 35 μcoul/gm (See Table B).

The invention has been described in detail with particular reference to certain preferred embodiments thereof, but it will be understood that variations and modifications can be effected within the spirit and scope of the invention.

Table B

Figure 3:
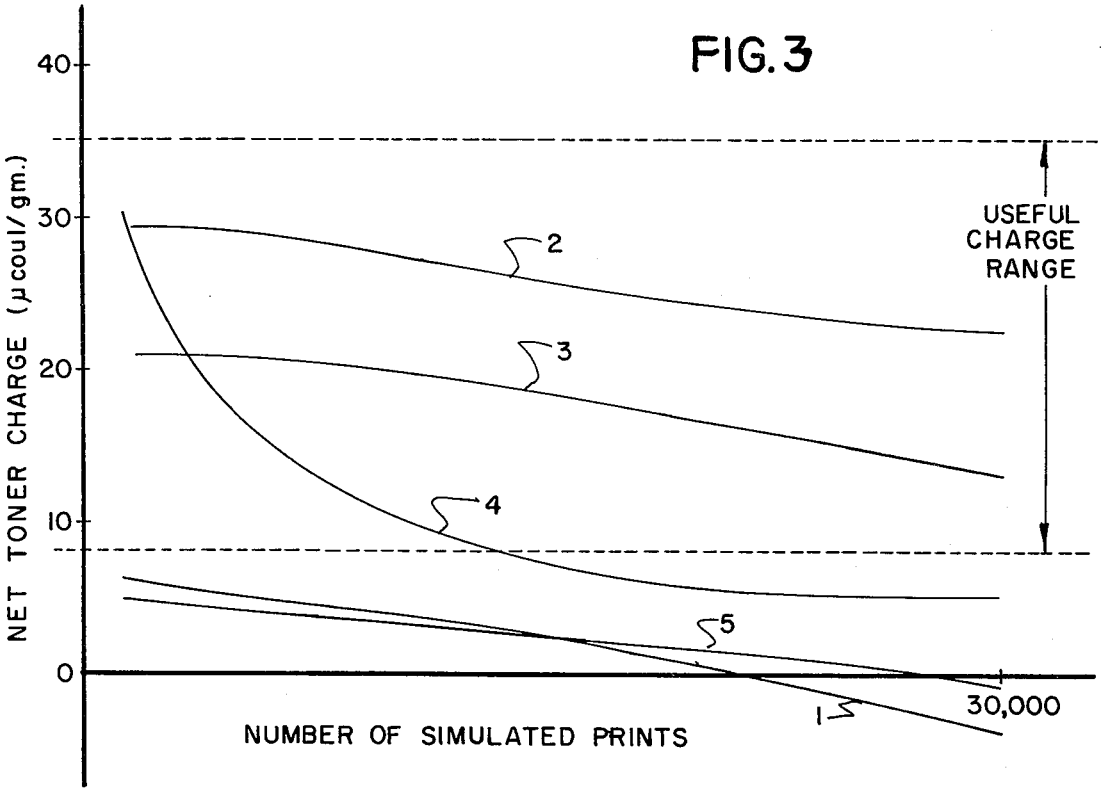
FIG. 3 is a graph showing the effect on the net toner charge of five toner compositions, Curves 1–5, subjected to an identical simulation test representing a 30,000 print run on an electrophotographic document copier. The difference among the five toner compositions tested is the amount of incorporated alkoxylated charge control agent.

Simulated 30,000 Print Test of Fig. 3

| Curve No. | Percent Concentration | Net Toner Charge (μcoul/gm) 15 min.[1] | 1 hour[2] | 2 hours[3] | 5 hours[4] |
|---|---|---|---|---|---|
| 1 | 0.00 | 5.9 | 4.1 | 3.1 | −3.5 |
| 2 | 0.47 | 29 | 29 | 26 | 22 |
| 3 | 0.94 | 21 | 20 | 19 | 13 |
| 4 | 2.77 | 30 | 14 | 7 | 4.9 |

Table B-continued

| Simulated 30,000 Print Test of Fig. 3 | | | | | |
|---|---|---|---|---|---|
| | | Net Toner Charge ($\mu$coul/gm) | | | |
| Curve No. | Percent Concentration | 15 min.[1] | 1 hour[2] | 2 hours[3] | 5 hours[4] |
| 5 | 4.50 | 4.8 | 3.7 | 2.8 | <0.0 |

[1] 15 minutes after start of simulated print test equivalent to approx. 1500 prints
[2] 1 hour after start of simulated print test equivalent to approx. 6,000 prints
[3] 2 hours after start of simulated print test equivalent to approx. 12,000 prints
[4] 5 hours after start of simulated print test equivalent to approx. 30,000 prints

We claim:

1. An electrographic developer composition for developing electrostatic charge patterns comprising carrier particles having a particle size within the range of about 30 to about 1200 microns and, electrostatically attractable thereto, a dry particulate electroscopic toner composition comprising finely-divided particles comprising a resin and an alkoxylated amine having the formula:

$$R-N\begin{matrix}[(CH_2)_aO]_xH \\ [(CH_2)_bO]_yH\end{matrix}$$

wherein $a$ and $b$ represent integers of from 2 to about 4 and may be the same or different, $x$ and $y$ represent integers of from 1 to about 10 and may be the same or different, and R is an alkyl group containing from about 8 to about 30 carbon atoms; said amine comprising less than about 2 weight percent of said finely-divided particles.

2. An electrographic developer composition for developing electrostatic charge patterns comprising carrier particles having a particle size within the range of about 30 to about 1200 microns and, electrostatically attractable thereto, a dry particulate electroscopic toner composition comprising finely-divided particles having a particle size of from about 0.1 micron to about 100 microns, said finely-divided particles comprising a resin having a softening temperature within the range of from about 40° to about 200° C. and having incorporated in said resin an alkoxylated amine having the following formula:

$$R-N\begin{matrix}[(CH_2)_aO]_xH \\ [(CH_2)_bO]_yH\end{matrix}$$

wherein $a$ and $b$ represent integers of from 2 to about 4 and may be the same or different; $x$ and $y$ represent integers of from about 1 to about 10 and may be the same or different, the sum of $x$ and $y$ equal to or less than about 10; and R is an alkyl group containing from about 12 to about 22 carbon atoms, said amine comprising less than about 1.5 weight percent of said finely-divided particles.

3. An electrographic developer composition as described in claim 2 wherein said toner composition comprises a pigment or a dyestuff in an amount effective to color said toner composition.

4. An electrographic developer composition for developing electrostatic charge patterns comprising carrier particles having a particle size within the range of about 30 to about 1200 microns and, electrostatically attractable thereto, a dry particulate electroscopic toner composition comprising finely-divided particles having an average particle size of from about 1.0 to about 30 microns, said finely-divided particles comprising a styrene-containing resin having a softening temperature within the range of from about 40° C to about 65° C and having uniformly dispersed throughout said resin (a) a pigment or dyestuff in an amount effective to color said resin and (b) an alkoxylated amine having the following formula:

$$R-N\begin{matrix}[(CH_2)_aO]_xH \\ [(CH_2)_bO]_yH\end{matrix}$$

wherein $a$ and $b$ are integers of from 2 to about 4; $x$ and $y$ represent integers of 1 to about 10 with the sum of $x$ and $y$ equal to or less than about 10; and R is a straight-chain alkyl group containing about 12 to about 22 carbon atoms, said amine comprising about 0.3 to less than about 1.5 weight percent of said finely-divided particles.

5. An electrographic developer composition as described in claim 4 wherein $a$ and $b$ are 2.

6. An electrographic developer composition for developing electrostatic charge patterns comprising carrier particles having a particle size within the range of about 30 to about 1200 microns and, electrostatically attractable thereto a dry particulate electroscopic toner composition for use in developing electrostatic charge patterns comprising finely-divided particles having an average particle size of from about 1.0 to about 30 microns, said particles comprising a styrene-containing resin having a softening temperature within the range of from about 40° C to about 65° C and having uniformly dispersed throughout said resin (a) a pigment or dyestuff in an amount effective to color said resin and (b) a wax-like, solid, alkoxylated amine having the following formula:

$$R-N\begin{matrix}[(CH_2)_aO]_xH \\ [(CH_2)_bO]_yH\end{matrix}$$

wherein $a$ and $b$ represent integers from 2 to about 4 and may be the same or different; $x$ and $y$ represent integers of from 1 to about 10 and may be the same or different, the sum of $x$ and $y$ equal to or less than about 10; and R is an alkyl group containing from about 12 to about 22 carbon atoms, said amine comprising about 0.3 to less than about 1.5 weight percent of said particles.

7. An electrographic developer composition comprising magnetically-attractable carrier particles having a particle size within the range of about 30 to about 1200 microns and having electrostatically attractable thereto dry, finely-divided toner particles having an average particle size within the range of about 1.0 to about 30 microns, and toner particles comprising a resin having a softening point within the range of from about 40° to about 200°C and having incorporated in said resin (a) a dyestuff or pigment in an amount effective to color said resin and (b) an alkoxylated amine having the following formula:

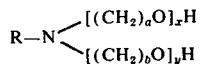

wherein *a* and *b* represent integers from 1 to about 4 and may be the same or different, *x* and *y* represent integers of from about 1 to about 10 and may be the same or different, and R is an alkyl group containing from about 8 to about 30 carbon atoms, said amine comprising from about 0.1 to less than about 2.0 weight percent of said toner particles.

8. An electrographic developer composition as described in claim 7 wherein said resin is a styrene-containing resin having a softening point within the range of from about 40° C to about 200°C.

9. An electrographic developer composition as described in claim 7 wherein said resin is a polycarbonate-containing resin having a glass transition temperature within the range of from about 40° to about 120°C.

* * * * *